United States Patent [19]

Breton et al.

[11] Patent Number: 4,925,179

[45] Date of Patent: May 15, 1990

[54] DELIVERY FAN WITH UNDULATED FAN POCKETS

[75] Inventors: Richard Breton, Rochester, N.H.; Ernest H. Treff, Groton, Conn.; Richard L. McKrell, Dover, N.H.

[73] Assignee: Harris Graphics Corporation, Dover, N.H.

[21] Appl. No.: 200,927

[22] Filed: Jun. 1, 1988

[51] Int. Cl.[5] ..... B65H 29/20

[52] U.S. Cl. ..... 271/187; 271/209; 271/315; 74/395; 74/424.8 R

[58] Field of Search ..... 271/187, 188, 315, 3, 271/264, 272, 204; 74/395, 424.8 R; 474/900

[56] References Cited

U.S. PATENT DOCUMENTS

| | | | |
|---|---|---|---|
| 1,845,600 | 2/1932 | Herr | 74/395 |
| 1,949,152 | 2/1934 | Fankboner | 271/315 |
| 4,222,556 | 9/1986 | Chapman et al. | 271/315 X |
| 4,522,387 | 6/1985 | Leuthold | 271/187 |
| 4,537,390 | 8/1985 | Kiamco et al. | 271/315 X |
| 4,600,186 | 7/1986 | Von Hein et al. | 271/315 X |
| 4,708,355 | 11/1987 | Wake et al. | 271/315 X |
| 4,709,820 | 12/1987 | Jenkins et al. | 271/315 X |

*Primary Examiner*—Kevin P. Shaver
*Assistant Examiner*—Kenneth R. DeRosa
*Attorney, Agent, or Firm*—Tarolli, Sundheim & Covell

[57] ABSTRACT

A delivery fan includes a plurality of blades defining a fan pocket for receiving a signature. The plurality of blades includes two sets of blades. The blades of one set are axially equally spaced apart and define one side of the pocket. The blades of the other set are axially equally spaced apart and define the other side of the pocket. The blades of both sets of blades have surfaces for engaging opposite sides of the signature and for deforming the signature into undulations extending in a direction transverse to the direction of movement of the signature. While the signature is being engaged and deformed, the frictional contact between the signature and the surfaces in the pocket slows down the signature. This minimizes buckling and/or bouncing of the signature in the pocket.

7 Claims, 4 Drawing Sheets

DELIVERY FAN WITH UNDULATED FAN POCKETS

TECHNICAL FIELD

The present invention relates to a delivery fan for receiving sheet material assemblages such as newspapers or the like, herein referred to as signatures, from a printing press and for forming an overlapped stream of the assemblages.

BACKGROUND ART

A delivery fan for receiving signatures from a printing press is well known. Typically, the delivery fan is positioned between a folder and a press delivery conveyor. The delivery fan includes a plurality of fan blades forming pockets for receiving a signature from the folder while the delivery fan rotates about its longitudinal central axis. The signatures in the fan pockets are removed from the fan pockets by a stripper and are transferred onto the delivery conveyor. The signatures are overlapped in a uniform stream on the delivery conveyor referred to as a shingled stream. The delivery conveyor then transports the overlapped signatures to a receiving station.

One problem associated with a conventional delivery fan is misalignment of a signature in a fan pocket. This results in misalignment of the signatures on the delivery conveyor when the signature is transferred from the fan pocket onto the delivery conveyor. Side guides disposed adjacent the delivery fan are used to prevent misalignment of the signature in the fan pocket. These side guides require manual setting and adjusting to accommodate different width signatures. This results in relative long makeready.

Another problem associated with a conventional delivery fan is buckling of the signature in the fan pocket when the signature is transferred from the folder into the fan pocket. The signature is moving at high speed. When the moving signature hits a part of the delivery fan and abruptly stops, buckling of the signature can occur. Buckling of the signature in the fan pocket may result in physical damage to the signature. Furthermore, if a buckled signature is transferred onto the delivery conveyor, then this signature would neither uniformly align with properly aligned signatures nor correctly overlap with its adjacent signatures.

SUMMARY OF THE INVENTION

In accordance with the present invention, an apparatus is provided for receiving sheet material assemblages and for forming the sheet material assemblages into an overlapped, shingled stream. The apparatus includes a plurality of blades defining a pocket for receiving a sheet material assemblage. The plurality of blades includes a first set of blades and a second set of blades. The blades of the first set are spaced axially apart from one another and define one side of the pocket for engaging one side of the sheet material assemblage. The blades of the second set are spaced axially apart from one another and define the other side of the pocket for engaging the other side of the sheet material assemblage. The blades of the first and second sets of blades have surfaces for engaging the opposite sides of the sheet material assemblage and for deforming the sheet material assemblage into a series of undulations. The undulations extend in a direction transverse to the direction of movement of the sheet material assemblage.

The present invention is preferably directed to a delivery fan for use in a printing press. A stream of signatures is transferred from a folder into fan pockets of the delivery fan. The signatures move into the fan pockets at high speeds. When a signature moving at high speed enters a fan pocket, buckling and/or bouncing of the signature in the fan pocket can occur. To prevent buckling and/or bouncing of the signature when it enters the fan pocket of the present invention, the signature is slowed by frictional contact between the surfaces of the fan pocket and the signature.

In one embodiment of the present invention, the first set of blades is in a fixed position relative to the position of the second set of blades. The first and second sets of blades have surfaces for engaging the opposite sides of the signature and for deforming the signature into a series of undulations. These undulations extend in a direction transverse to the direction of movement of the signature. While the signature is being engaged and deformed, the frictional contact between the signature and the blades slows down the signature.

In a second embodiment, the first set of blades is circumferentially adjustable relative to the second set of blades. By moving the blades of the first set circumferentially relative to the blades of the second set, different thickness signatures can be accommodated and/or the size of the undulations can be varied. By varying the size of the undulations, the amount of frictional contact provided for slowing down the signature is varied.

By slowing down the signature as it enters the fan pocket, buckling of the signature in the fan pocket is minimized. Furthermore, bouncing of the signature in the fan pocket is minimized. Thus, side guides are not required and can be eliminated. Since side guides are not required, no setting or adjusting of side guides are required. Thus, makeready time is reduced.

BRIEF DESCRIPTION OF THE DRAWINGS

The foregoing and other objects and features of the present invention will become apparent to one skilled in the art to which the present invention relates from reading the following description of preferred embodiments of the present invention in conjunction with the accompanying drawings, wherein.

DESCRIPTION OF PREFERRED EMBODIMENTS

Figure 1:
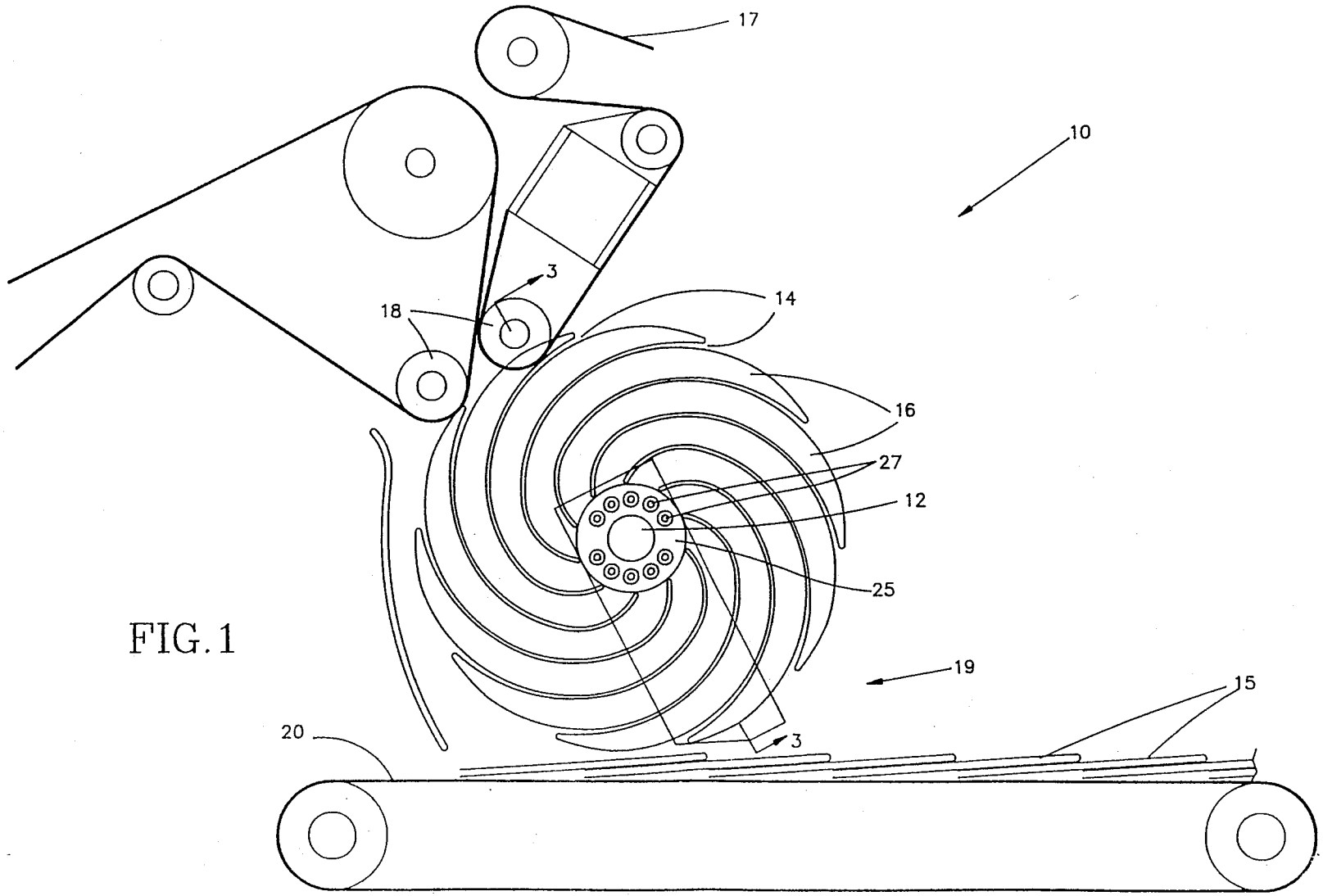
FIG. 1 is a schematic illustration of a portion of a printing press having a delivery fan constructed in accordance with the present invention.

The present invention relates to an apparatus for receiving a stream of sheet material assemblages, such as newspapers or the like, and for overlapping the stream of the sheet material assemblages. In particular, the present invention is embodied in a delivery fan for use in a printing press. The delivery fan receives a stream of signatures transferred from a folder. The delivery fan transfers the signatures onto a delivery conveyor and forms a uniform, overlapped stream on the delivery conveyor. As representative of the present invention, a delivery fan 10 is illustrated in FIG. 1.

The delivery fan 10 includes a shaft 12 supported for rotation about its longitudinal central axis. The fan 10 further includes a plurality of curved fan blades 16 defining a plurality of fan pockets 14. A stream of signatures is transferred from a folder (not shown) through an arrangement of belts 17 and a set of rollers 18 into the pockets 14. Each signature is carried in one of the pockets 14 until the leading edge of the signature engages a plurality of plates (only one of which is shown in FIG. 1) of a stripper assembly 19. The plates of the stripper assembly 19 strip each signature from its pocket and transfers the signature onto a delivery conveyor 20. A uniform, overlapped stream 15 of signatures is formed on the delivery conveyor 20. The uniform, overlapped stream 15 of signatures is subsequently transported to a stacking station or the like (not shown).

Figure 2:
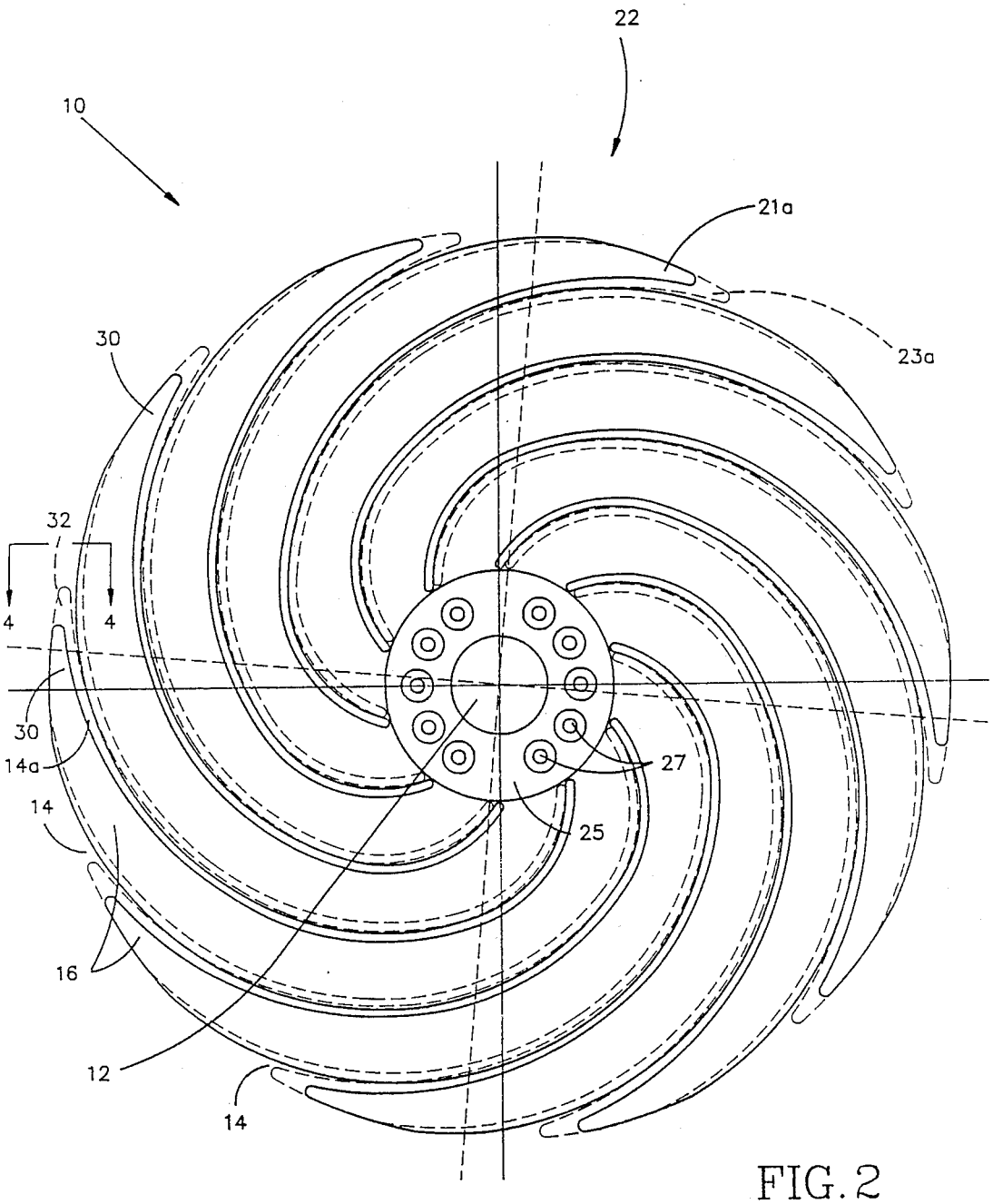
FIG. 2 is an enlarged view illustrating the construction of the delivery fan of FIG. 1.
Figure 3:
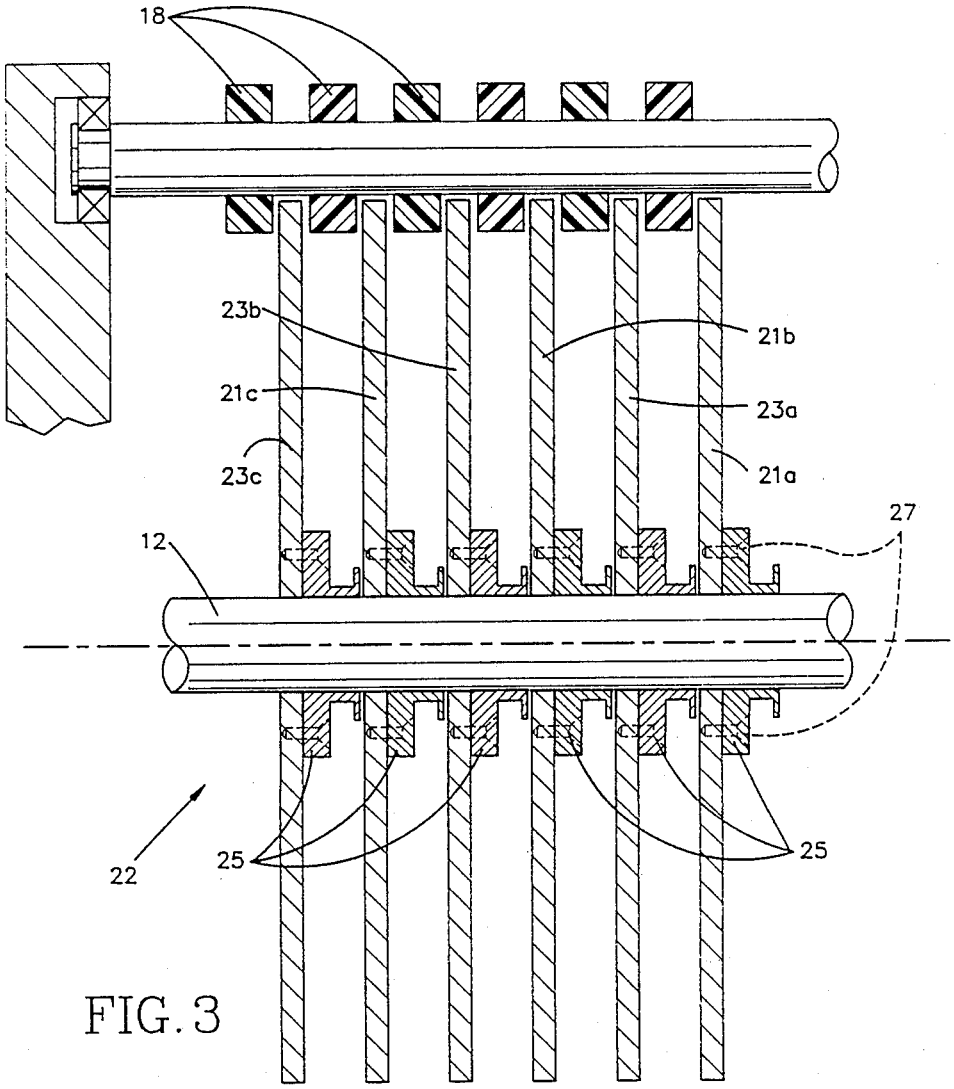
FIG. 3 is a view taken approximately along line 3—3 of FIG. 1 and showing portions in section.

Referring to FIGS. 2 and 3, the fan 10 includes a plurality of cylindrical hubs 25. Each hub is suitably fixed to the shaft 12 to rotate with the shaft 12. The fan 10 further includes a plurality of fan discs 22. Each disc is identical to the others. Each disc is fastened to an associated hub by a plurality of suitable fasteners 27.

The discs 22 are equally spaced along the axial extent of the shaft 12. The longitudinal central axis of the shaft 12 passes through the geometric center of the hub of each disc. The plurality of fan discs 22 is divided into a first group of discs 21*a*, 21*b*, 21*c* and a second group of discs 23*a*, 23*b*, 23*c*. The discs 21*a*, 21*b*, 21*c* alternate with the discs 23*a*, 23*b*, 23*c* along the shaft 12. Each disc has an equal number of the fan blades 16. The blades associated with each disc extend radially from the outer periphery of the hub of the respective disc. The blades are circumferentially and equally spaced apart around the outer periphery of the hub of the associated disc.

The first group of discs 21*a*, 21*b*, 21*c* is arranged such that the blades of each disc align with the blades of the other discs of the first group along the axial extent of the shaft 12. The second group of discs 23*a*, 23*b*, 23*c* is arranged such that the blades of each disc also align with the blades of the other discs of the second group along the axial extent of the shaft 12. The blades of the second group of discs 23*a*, 23*b*, 23*c* are circumferentially spaced around the shaft 12 from the blades of the first group of discs 21*a*, 21*b*, 21*c*.

The blades of the first and second groups of discs form the plurality of fan pockets 14 for receiving the stream of signatures transferred from the folder. Since each of the fan blades 16 has a curved shape, each of the pockets 14 has a spiral-like shape. Each of the fan pockets 14 is identical and formed in the same manner. For simplicity and explanation purposes, only one pocket 14*a* is described in detail hereinbelow.

Figure 4:
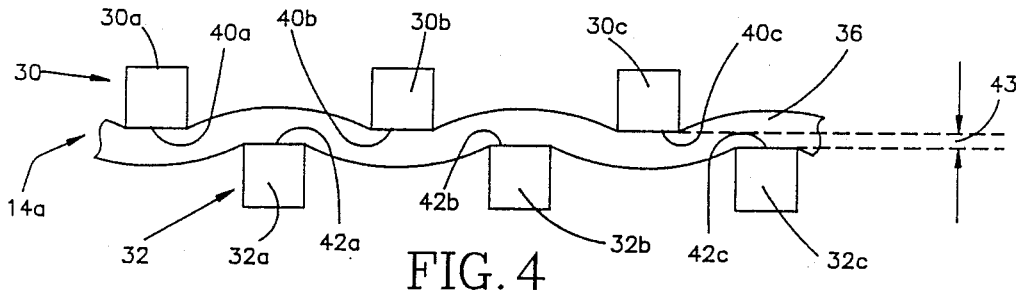
FIG. 4 is an enlarged, partial view taken approximately along line 4—4 of FIG. 2 and illustrating details of a fan pocket.

Referring to FIG. 4, a first set 30 of blades defines one side of the pocket 14*a*. The first set 30 of blades includes one blade 30*a*, 30*b*, 30*c* from each of the discs 21*a*, 21*b*, 21*c*, respectively, of the first group of discs. A second set 32 of blades defines the other side of the pocket 14*a*. The second set 32 of blades includes one blade 32*a*, 32*b*, 32*c* from each of the discs 23*a*, 23*b*, 23*c*, respectively, of the second group of discs. The first set 30 of blades is circumferentially spaced apart from the second set 32 of blades.

The blades 30*a*, 30*b*, 30*c* of the first set 30 of blades have surfaces 40*a*, 40*b*, 40*c*, respectively, defining one side of the pocket 14*a*. The blades 32*a*, 32*b*, 32*c* of the second set 32 of blades have surfaces 42*a*, 42*b*, 42*c*, respectively, defining the other side of the pocket 14*a*. The circumferential width 43 of the pocket 14*a* depends upon the amount of circumferential spacing between the first set 30 of blades and the second set 32 of blades. The discs are adjusted so that the surfaces 40*a*, 40*b*, 40*c* are spaced circumferentially away from the surfaces 42*a*, 42*b*, 42*c*. The circumferential width 43 of the pocket 14*a* is less than the thickness of a signature to be transferred into the pocket 14*a*.

When a signature, designated 36 in FIG. 4, is transferred into the pocket 14*a*, one side of the signature 36 engages the surfaces 40*a*, 40*b*, 40*c* and the other side of the signature 36 engages the surfaces 42*a*, 42*b*, 42*c*. The signature 36 thus deforms into undulations extending in a direction transverse to the direction of movement of the signature 36. While the signature 36 is engaging the surfaces 40*a*, 40*b*, 40*c* and 42*a*, 42*b*, 42*c* and deforming into undulations, the frictional contact between the signature 36 and the two surfaces slows down the speed at which the signature 36 is moving into the pocket 14*a*.

The signature 36 continues to move into the pocket 14*a*. Eventually, the leading edge of the signature 36 may hit the bottom of the pocket 14*a*. By slowing down the speed at which the signature 36 is moving into the pocket 14*a*, buckling and/or bouncing of the signature 36 in the pocket 14*a* is minimized. Physical damage to the signature 36 is thereby minimized and misalignment of the signature is minimized.

The delivery fan 10 rotates about its longitudinal central axis while the signature 36 enters the pocket 14*a*. The delivery fan 10 continues to rotate about its longitudinal central axis with the signature 36 in the pocket 14*a*. The signature is carried in the pocket 14*a* until the leading edge of the signature 36 strikes against the plurality of plates of the stripper assembly 19. These plates are supported by the hubs 25 connected to the shaft 12, as is known in the art.

When the leading edge of the signature 36 strikes against the plates, the signature 36 is thus prevented from being carried any further in the pocket 14*a* with the rotation of the delivery fan 10 about its longitudinal central axis. As the delivery fan 10 continues to rotate, the delivery fan 10 moves away from the signature 36. This results in stripping of the signature 36 from the pocket 14*a*.

After the signature 36 is stripped from the pocket 14*a*, the signature 36 is transferred onto the delivery conveyor 20. The leading edge of the signature 36 uniformly aligns with other signatures already on the delivery conveyor 20. Thus, a uniform, overlapped stream 15 of signatures is formed on the delivery conveyor 20.

No side plates are required to provide the uniform, overlapped stream 15 of signatures on the delivery conveyor 20. Therefore, no setting or adjustments of side guides or the like are required. Makeready time is thereby reduced.

It is contemplated that it may be desirable to circumferentially move one group of discs such as discs 21*a*, 21*b*, 21*c* relative to the other group of discs 23*a*, 23*b*, 23*c*. When one group of discs is circumferentially moved relative to the other group of discs, the circumferential width 43 of the pocket 14*a* is varied and the degree or size of the undulations is varied. A pocket having a different circumferential width can accommodate a signature of a different thickness. For instance, the thickness of a signature is different if the signature is of different stock (material).

Figure 5:
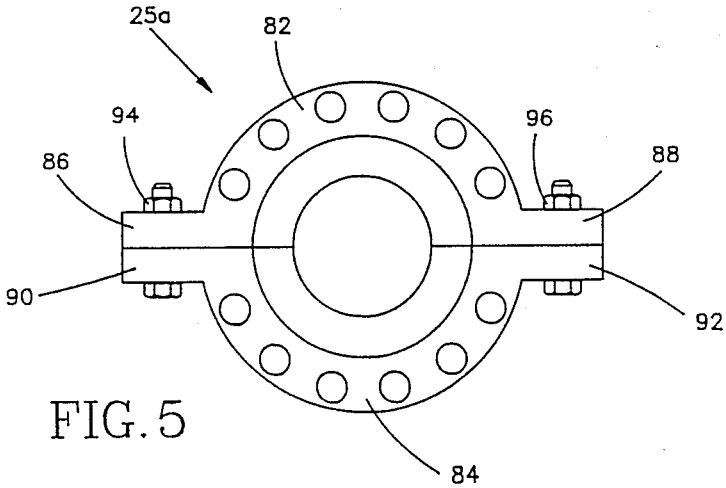
FIG. 5 is an enlarged, detailed view illustrating a cylindrical hub used in the delivery fan of FIG. 1.

Referring to FIG. 5, one hub 25a of the plurality of hubs 25 is shown. The hub 25a is constructed of two semi-cylindrical pieces 82, 84. The one piece 82 has a pair of flanges 86, 88, each of the flanges 86, 88 having a hole. Similarly, the one piece 84 has a pair of flanges 90, 92, each of the flanges 90, 92 having a hole. A fastener 94 is inserted into the hole in the flange 86 and the hole in the flange 90 and is secured to hold the two pieces 82, 84 together. Another fastener 96 is inserted into the hole in the flange 88 and the hole in the flange 92 and is secured to hold the two pieces 82, 84 together.

When both fasteners 94, 96 are secured, the hub 25a is held in a fixed position relative to the shaft 12. If it is desired to circumferentially move the hub 25a relative to the shaft 12, then the two fasteners 94, 96 are loosened so that the two pieces 82, 84 of the hub 25a can be moved. After moving the two pieces 82, 84 to the desired position, the two fasteners 94, 96 are secured again to hold the hub 25a in a fixed position relative to the shaft 12. Each hub of the plurality of hubs 25 is constructed in the same manner and is independently movable around the circumference of the shaft 12. Thus, the discs 21a, 21b, 21c and 23a, 23b, 23c are independently adjustable around the shaft 12 to thereby vary the circumferential width of the pockets 14.

Figure 6:
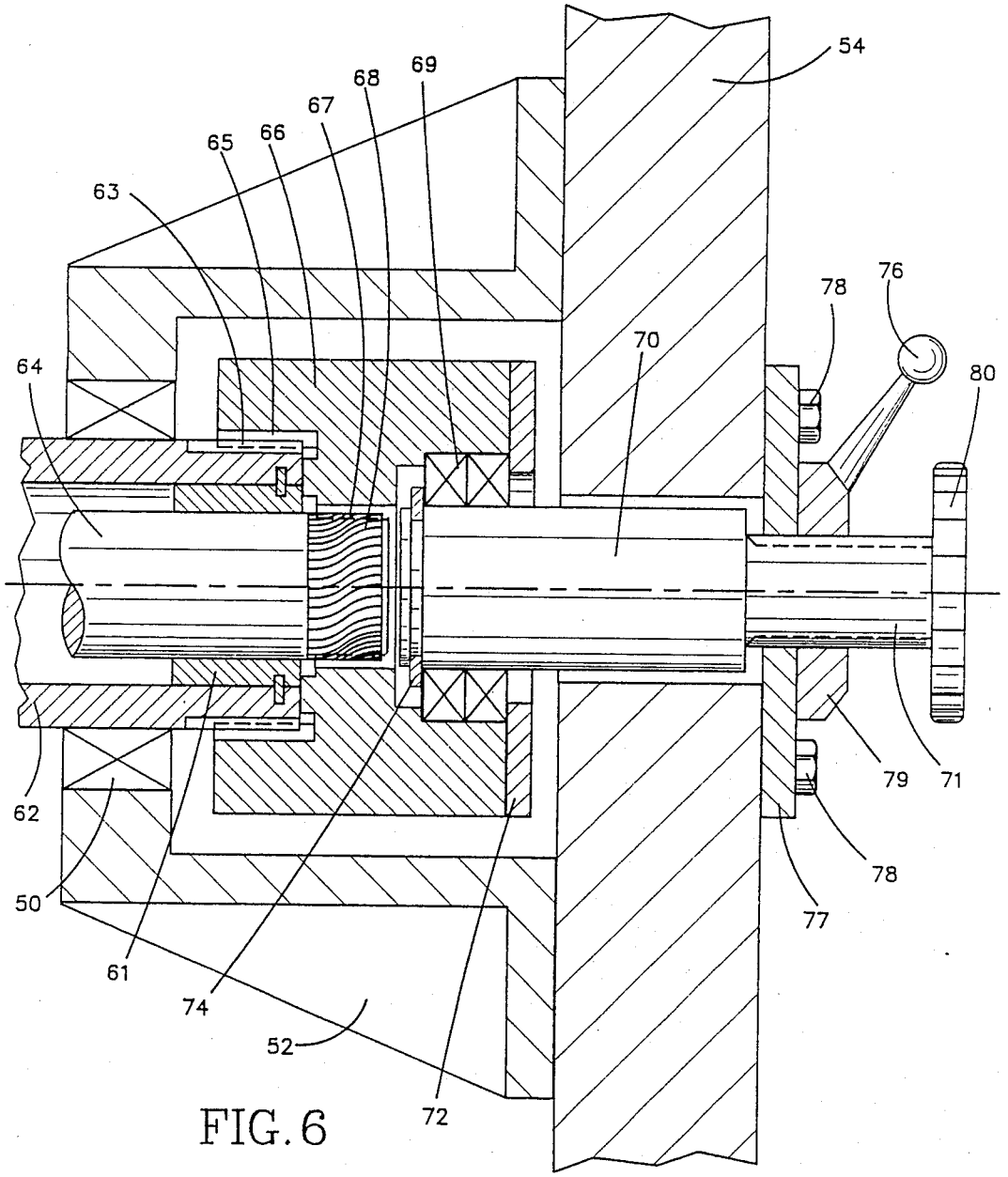
FIG. 6 illustrates a portion of a second embodiment of the invention in which a first set of blades in the delivery fan of FIG. 1 is relatively movable with respect to a second set of blades.

Referring to FIG. 6, another embodiment of the present invention is illustrated. In this embodiment, the first group of discs (not shown) is supported by and attached to the outer periphery of a first shaft 62. The first shaft 62 is supported for rotation about its longitudinal central axis by a bearing 50 in a bearing housing 52. The bearing housing 52 is fixedly connected to a frame 54.

A second shaft 64 is coaxial within the first shaft 62. The second group of discs (not shown) is supported by and attached to the outer periphery of the second shaft 64 through slot openings (not shown) in the first shaft 62. The slot openings in the first shaft 62 are located between each disc of the first group of discs. Thus, the discs of the second group of discs alternate with the discs of the first group of discs along the axial extent of the first and second shafts 62, 64. Each slot opening in the first shaft 62 has a circumferential extent large enough to allow the second group of discs to circumferentially move within predetermined limits relative to the first group of discs.

A bearing 61 establishes a fixed radial relationship between the first shaft 62 and the second shaft 64. Spur gear teeth 63 are on one end of the first shaft 62. The spur gear teeth 63 meshingly engage with spur gear teeth 65 disposed on an internal diameter at one end of a drive collar 66. Helical gear teeth 68 are disposed on another internal diameter in the central portion of the drive collar 66. The helical gear teeth 67 meshingly engage with helical gear teeth 68 disposed on one end of the second shaft 64. Thus, the drive collar 66 causes the shafts 62, 64 to rotate together which, in turn, causes the discs 21a, 21b, 21c and 23a, 23b, 23c to rotate together.

During operation, a motor (not shown) drives the first shaft 62 to rotate about its longitudinal central axis. The rotation of the first shaft 62 is translated into rotation of the drive collar 66 through the meshing engagement of the spur gear teeth 63 and the spur gear teeth 65. The rotation of the drive collar 66 is translated into rotation of the second shaft 64 about its longitudinal central axis through the meshing engagement of the helical gear teeth 67 and the helical gear teeth 68. Thus, the first shaft 62 and the second shaft 64 rotate in unison about the longitudinal central axis when the first shaft 62 is driven by the motor. Thus, the discs defining the pockets 14 rotate together.

The second group of discs can be circumferentially adjusted relative to the first group of discs to vary the circumferential width of the pockets 14 by relative rotation of shafts 62, 64. This is accomplished by rotation of an adjustment shaft 70. A bearing 69 establishes a fixed radial relationship between an end of the drive collar 66 and the adjustment shaft 70. An annular plate 72 is fastened to the drive collar 66 to hold the bearing 69 in place between the drive collar 66 and the adjustment shaft 70.

A snap ring 74 is connected to and encircles one end of the adjustment shaft 70. A portion of the surface of the outer protrusion of the snap ring 74 abuttingly engages the bearing 69.

The adjustment shaft 70 has a threaded section 71. The threads of the threaded section 71 of the adjustment shaft 70 threadingly engage threads on the inner diameter of a hole in a plate 77. The plate 77 is fastened to the frame 54 by suitable fasteners 78. The threads of the threaded section 71 also threadingly engage threads on the inner diameter of the hole of a locknut 79. The locknut 79 is loosened and tightened using a lever 76 attached to the locknut 79. A manual handle 80 is fixedly connected to the threaded section 71 of the adjustment shaft 70.

Rotation of the manual handle 80 circumferentially moves the second group of discs relative to the first group of discs. It is possible to rotate the handle 80 while the two shafts 62, 64 are rotating about their longitudinal central axis. However, it is preferable to operate the handle 80 when the two shafts 62, 64 are at a standstill. The locknut 79 is loosened by movement of the lever 76 so that the handle 80 can be rotated. After the handle 80 is rotated, the locknut 79 is re-tightened with the lever 76 to prevent inadvertent movement of the handle 80.

The manual handle 80 is rotatable in two directions within predetermined limits from an initial position. In the initial position, the blades of the first group of discs are aligned with the blades of the second group of discs along the axial extent of the two shafts 62, 64. Rotation of the handle 80 in one direction rotates the adjustment shaft 70 about its longitudinal central axis in one direction. The adjustment shaft 70 moves axially in one direction because of the threaded section 71 of the adjustment shaft 70 rotating about its longitudinal central axis. This axial movement of the adjustment shaft 70 results in axial movement of the drive collar 66 in one direction. This axial movement of the drive collar 66 is translated into rotational movement of the shaft 64 in one direction due to the meshing engagement of the helical gear teeth 67 and the helical gear teeth 68. The axial movement the drive collar 66 is not translated into any movement of the first shaft 62. This is because of the meshing engagement of the spur gear teeth 63 and the spur gear teeth 65.

Rotation of the handle 80 in the other direction rotates the adjustment shaft 70 about its longitudinal central axis in the other direction. The adjustment shaft 70 moves axially in the other direction. This axial movement results in axial movement of the drive collar 66 in the other direction. This axial movement of the drive collar 66 is translated into rotational movement of the second shaft 64 in the other direction through the meshing engagement of the helical gear teeth 67 and the helical gear teeth 68. Again, the axial movement of the drive collar 66 is not translated into any movement of the first shaft 62. The second shaft 64 rotates about its longitudinal central axis in the other direction relative to the first shaft 62. Thus, rotation of the handle 80 in either direction from its initial position results in circumferential relative movement of the first and second groups of discs.

It is contemplated that other ways of circumferentially moving one group of discs relative to the other group of discs are possible. One way is to use a pneumatic cylinder which is manually controllable. Another way is to use simple or complex mechanical linkages.

The invention has been described with reference to preferred embodiments. Modifications and alterations may become apparent to one skilled in the art upon reading and understanding the specification. It is intended to include all such modifications and alterations within the scope of the appended claims.

Having described preferred embodiments of the invention, I claim:

1. An apparatus for receiving sheet material assemblages and for forming an overlapped stream of the sheet material assemblages, said apparatus comprising:

a plurality of blades;

said plurality of blades including a first set of blades, said blades of said first set of blades being rotatably mounted about an axis and being spaced axially apart from one another and having surfaces that define side of said pocket for engaging one side of a sheet material assemblage;

said plurality of blades including a second set of blades, said blades of said second set of blades being rotatably mounted about the axis and being spaced axially apart from one another and having surfaces defining the other side of said pocket for engaging the other side of the sheet material assemblage, said blades of first and second sets of blades being circumferentially spaced apart and rotating about the axis when receiving sheet material assemblages and forming the overlapped stream of the sheet material assemblages;

said surfaces of said blades of said first and second sets of blades deforming the sheet material assemblage into a series of undulations, the undulations extending in a direction transverse to the direction of movement of the sheet material assemblage; and means for adjusting the extent of the circumferential spacing between said first and second sets of blades while said blades of said first and second sets of blades are rotating about the axis, the amount of deformation of the sheet material assemblage and the size of the undulations varying as a function of the amount of circumferential spacing between said first set of blades and said second set of blades.

2. An apparatus for receiving sheet material assemblages and for forming an overlapped stream of the sheet material assemblages, said apparatus comprising:

a plurality of blades;

said plurality of blades including a first set of blades, said blades of said first set of blades being rotatably mounted about an axis and being spaced axially apart from one another and having surfaces that define one side of said pocket for engaging one side of a sheet material assemblage;

said plurality of blades including a second set of blades, said blades of said second set of blades being rotatably mounted about the axis and being spaced axially apart from one another and having surfaces that define the other side of said pocket for engaging the other side of the sheet material assemblage, said blades of first and second sets of blades being circumferentially spaced apart and rotating about the axis when receiving sheet material assemblages and forming the overlapped stream of the sheet material assemblages;

said surfaces of said blades of said first and second sets of blades deforming the sheet material assemblage into a series of undulations, the undulations extending in a direction transverse to the direction of movement of the sheet material assemblage; and means for supporting said first and second sets of blades for circumferential relative movement therebetween to adjust the circumferential spacing between said first and second sets of blades to thereby adjust the amount of deformation of the sheet material assemblage, the size of the undulations varying as a function of the amount of circumferential spacing between said first set of blades and said second set of blades, said supporting means including a first shaft connected to said first set of blades and having its longitudinal central axis coinciding with the axis of said first and second sets of blades, a second shaft coaxial with and concentric within said first shaft and connected to said second set of blades, said second set of blades being circumferentially adjusted relative to said first set of blades when said second shaft is rotated relative to said first shaft about the longitudinal central axis of said first and second shafts.

3. The apparatus of claim 2 wherein said adjustment means includes a cylindrical drive collar coaxial with said first and second shafts, said drive collar having spur gear teeth in meshing engagement with spur gear teeth disposed on one end of said first shaft, said drive collar having helical gear teeth in meshing engagement with helical gear teeth disposed on one end of said second shaft, said first shaft driving said second shaft to rotate together with said first shaft about its longitudinal central axis through the meshing engagement of the spur gear teeth between said drive collar and said first shaft and the meshing engagement of the helical gear teeth between said drive collar and said second shaft when said first shaft is rotated about its longitudinal central axis.

4. The apparatus of claim 3 wherein said adjustment means includes an axially movable adjustment shaft supported for rotation about its longitudinal central axis and coaxial with said first and second shafts, said adjustment shaft moving axially in one direction when said adjustment shaft is rotated about its longitudinal central axis in one direction, said adjustment shaft moving axially in the other direction when said adjustment shaft is rotated about its longitudinal central axis in the other direction, and means connecting said adjustment shaft with said drive collar to axially move said drive collar with said adjustment shaft when said adjustment shaft is rotated about its longitudinal central axis, the axial movement of said drive collar being translated into rotation of said second shaft about its longitudinal central axis through the meshing engagement of the helical gear teeth between said drive collar and said second shaft.

5. An apparatus for receiving sheet material assemblages and for forming an overlapped stream of the sheet material assemblages, said apparatus comprising:

a first shaft supported for rotation about its longitudinal central axis;

a second shaft coaxial with said first shaft and supported for rotation about its longitudinal central axis;

a plurality of blades including a first set of blades connected to said first shaft, said blades of said first set of blades being spaced axially apart from one another along the longitudinal central axis of said first shaft and having surfaces defining one side of a pocket for engaging one side of a sheet material assemblage, and a second set of blades connected to said second shaft, said blades of said second set of blades being spaced axially apart form one another along the longitudinal central axis of said second shaft and having surfaces defining the other side of said pocket for engaging the other side of the sheet material assemblage, said blades of said first and second sets of blades being circumferentially spaced apart and rotating with said first and second shafts about their longitudinal central axes when receiving sheet material assemblages and forming the overlapped stream of sheet material assemblages;

said surfaces of said blades of said first and second sets of blades deforming the sheet material assemblage into a series of undulations, the undulations extending in a direction transverse to the direction of movement of the sheet material assemblage; and means for adjusting the extent of the circumferential spacing between said first and second sets of blades while said blades of said first and second sets of blades are rotating about the longitudinal central axes of said first and second shafts, the amount of deformation of the sheet material assemblage and the size of the undulations varying as a function of the amount of circumferential spacing between said first set of blades and said second set of blades.

6. The apparatus of claim 5 wherein said adjusting means includes means for supporting said first and second shafts for relative rotational movement, the extent of the circumferential spacing between said first and second sets of blades being adjusted upon relative rotational movement between said first and second shafts.

7. An apparatus for receiving sheet material assemblages and for forming an overlapped stream of the sheet material assemblages, said apparatus comprising:

a shaft rotatable about its longitudinal central axis;

a plurality of cylindrical hubs, each of said hubs having a geometric center through which the longitudinal central axis of said shaft passes, each of said hubs being spaced along the axial extent of said shaft;

means for releasably fastening each of said hubs to said shaft to rotate with said shaft and being releasable to enable circumferential adjustment of each of said hubs around said shaft;

a plurality of fan discs including a first group of fan discs and a second group of fan discs, said discs of said first group of discs alternating with said discs of said second group of discs along the axial extent of said shaft;

means for attaching each of said fan discs to a respective one of said hubs, each of said plurality of fan discs having a fan blade extending radially from the outer periphery of its associated hub, said blades of said second group of discs being circumferentially spaced around said shaft from said blades of said first group of discs due to the positioning of said hubs for said second group of discs relative to said hubs for said first group of discs;

said blades of said first group of discs having surfaces defining one side of said pocket for engaging one side of the sheet material assemblage, said blades of said second group of discs having surfaces defining the other side of said pocket for engaging the other side of the sheet material assemblage, said blades of said first and second groups of discs rotating about the longitudinal central axis of said shaft when receiving sheet material assemblages and forming the overlapped stream of the sheet material assemblages; and said surfaces of said blades of said first and second groups of discs deforming the sheet material assemblage into a series of undulations, the undulations extending in a direction transverse to the direction of movement of the sheet material assemblage, the size of the undulations varying as a function of the amount of circumferential spacing between said blades of said first group of discs and said blades of said second group of discs due to the relative positioning of said hubs on said shaft.

* * * * *

UNITED STATES PATENT AND TRADEMARK OFFICE

CERTIFICATE OF CORRECTION

PATENT NO. : 4,925,179

DATED : May 15, 1990

INVENTOR(S) : Richard Breton, Ernest H. Treff, and Richard L. McKrell

It is certified that error appears in the above-identified patent and that said Letters Patent is hereby corrected as shown below:

Column 7, Line 35, Claim 1, insert --one-- after "define" before "side".

Column 7, Line 35, Claim 1, change "said" to --a--.

Column 7, Line 41, Claim 1, change "defining" to -- that define--.

Column 8, Line 1, Claim 2, change "said" to --a--.

Column 9, Line 15, Claim 5, change "defining" to -- that define--.

Column 9, Line 19, Claim 5, change "form" to --from--.

Column 9, Line 21, Claim 5, change "defining" to -- that define--.

Signed and Sealed this

Seventeenth Day of September, 1991

*Attest:*

*Attesting Officer*

HARRY F. MANBECK, JR.

*Commissioner of Patents and Trademarks*